US005921664A

United States Patent [19]

Lee

[11] Patent Number: 5,921,664

[45] Date of Patent: Jul. 13, 1999

[54] READING LAMP

[76] Inventor: Wen-Song Lee, 58, Ma Yuan West St., Taichung, Taiwan

[21] Appl. No.: 08/938,008

[22] Filed: Sep. 12, 1997

[51] Int. Cl.[6] ..... F21L 15/14; F21V 7/00

[52] U.S. Cl. ..... 362/296; 362/108; 362/190

[58] Field of Search ..... 362/108, 103, 362/137, 138, 155, 296, 374, 375, 98, 190

[56] References Cited

U.S. PATENT DOCUMENTS 1,435,160 11/1922 Hoegemann ..... 362/103

5,183,324 2/1993 Thomas ..... 362/103

5,412,896 5/1995 Morgan ..... 362/108

*Primary Examiner*—Sandra O'Shea

*Assistant Examiner*—Michael J. Smith

[57] ABSTRACT

A reading lamp has a base seat, a hollow casing disposed on the base seat, a link device disposed between the base seat and the hollow casing, a lamp disposed between the base seat and the hollow casing, a button disposed on the hollow casing, a transparent plate disposed in the hollow casing, and a cover disposed on the hollow casing covering the transparent plate. The cover has a mirror reflecting a light from a bulb to a book while the cover is opened.

3 Claims, 5 Drawing Sheets

READING LAMP

BACKGROUND OF THE INVENTION

The present invention relates to a reading lamp. More particularly, the present invention relates to a reading lamp which is hung on the neck of the user.

A conventional lamp cannot be carried by the user. The user can hold a flashlight with one hand and hold a book with the other hand while reading the book outdoors at night. However, it is difficult to hold a flashlight with one hand and to browse the book with the other hand.

SUMMARY OF THE INVENTION

An object of the present invention is to provide a reading lamp which can be hung on the neck of the user.

Another object of the present invention is to provide a reading lamp which can focus a light on a certain area so that the other people will not be disturbed while sleeping.

Accordingly, a reading lamp comprises a base seat, a hollow casing disposed on the base seat, a link device disposed between the base seat and the hollow casing, a lamp disposed between the base seat and the hollow casing, a button disposed on the hollow casing, a transparent plate disposed in the hollow casing, and a cover disposed on the hollow casing covering the transparent plate. The base seat has a positioning block disposed in a front portion of the base seat, two hollow posts disposed in a front portion of the base seat, two grooved plates disposed in a front portion of the base seat, two clip grooves formed in a front portion of the base seat, a front interior, a cell chamber disposed in the base seat, an elongated recess formed on a rear portion of the base seat, and two rectangular recesses formed on the rear portion of the base seat. A triangular block is disposed on the cell chamber. The hollow casing has two pivot seats, a through hole, two lateral recesses, an oblong recess, three cage holes formed on the oblong recess, a recess seat disposed in the hollow casing, a conductive plate disposed on the recess seat, a positioning portion formed on a front bottom of the hollow casing, two hollow pillars disposed on the front bottom of the hollow casing, two clip notches formed on a front bottom of the hollow casing, a clip plate disposed on a rear portion of the hollow casing, and a rectangular groove formed on the clip plate. The lamp has a bulb. A lamp holder has two positioning posts and two columns. A link device has two parallel rods, two arms, each arm having an aperture, and a plurality of ribs disposed between the rods. The positioning posts are inserted in the apertures. The grooved plates receive the columns. The lamp couples with the lamp holder. Two cylindrical retainers are disposed between the rectangular recesses and the rectangular groove. A rope has two ends inserted in the cylindrical retainers. A transparent lamp housing has two positioning protrusions and two clip blocks. The transparent lamp housing is disposed between the positioning portion of the hollow casing and the front portion of the base seat. The clip blocks engage with the clip grooves. The transparent plate has two lugs inserted in the lateral recesses. The cover has a mirror disposed on a bottom of the cover and two hollow lobes disposed on two rear laterals of the cover. Two pivot fasteners pass through the hollow lobes and are inserted in the pivot seats. The button has a snap fastener and two clip fasteners inserted in the cage holes.

DETAILED DESCRIPTION OF THE INVENTION

Figure 1:
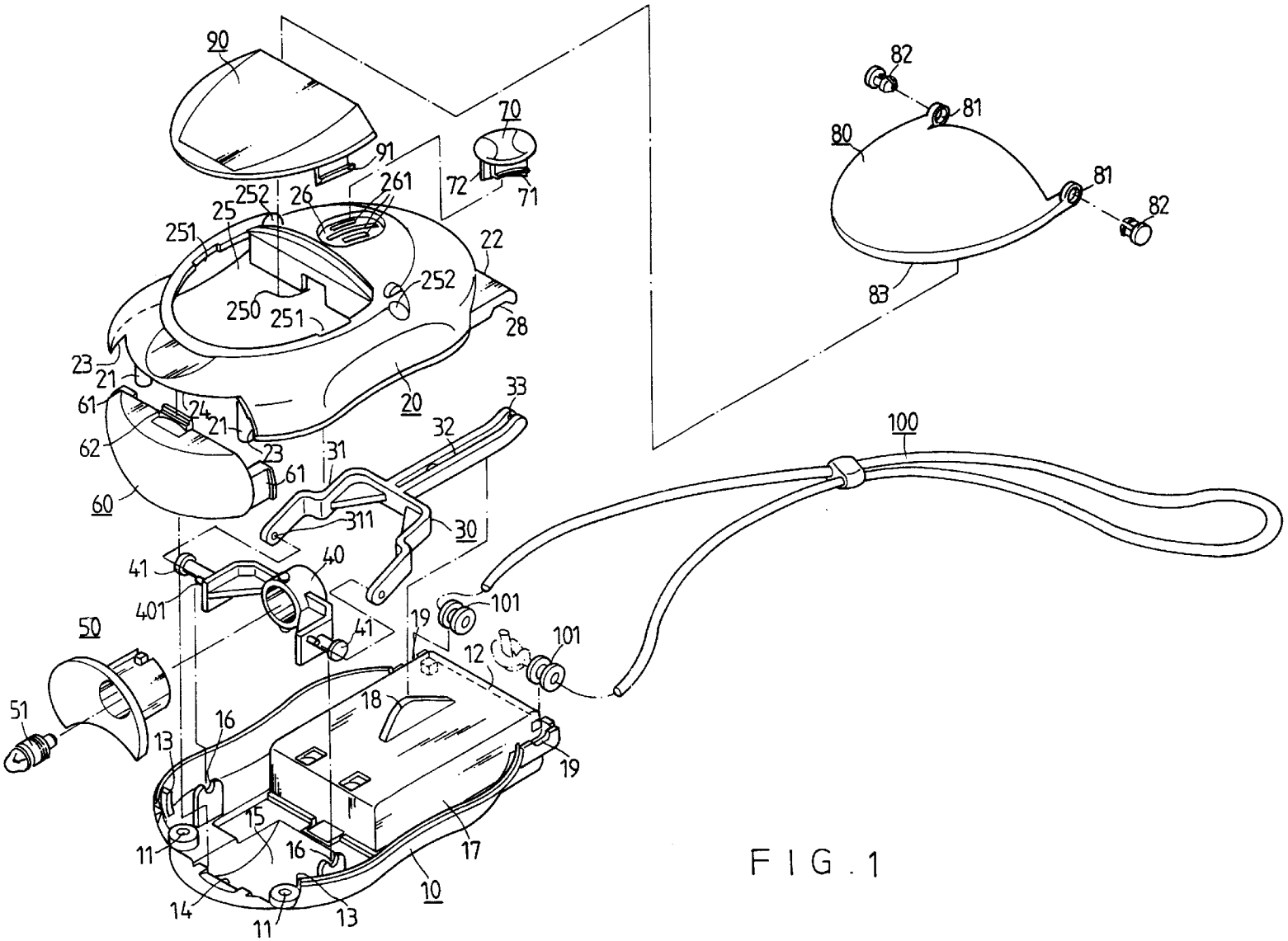
FIG. 1 is a perspective exploded view of a reading lamp of a preferred embodiment in accordance with the present invention.
Figure 1A:
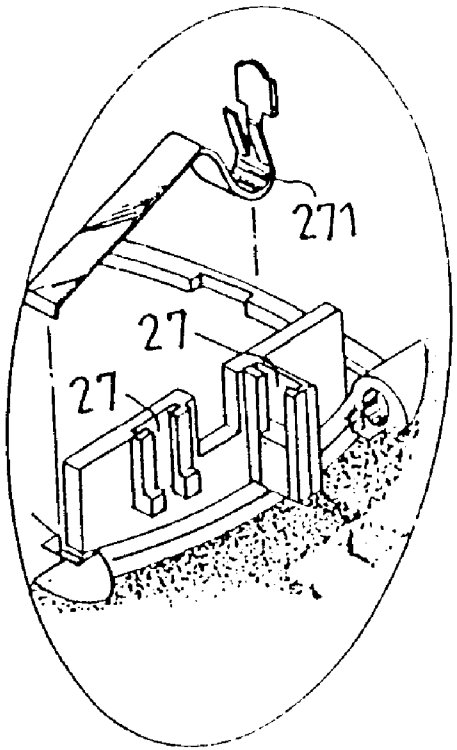
FIG. 1A is a perspective view of a conductive plate and a recess seat in a hollow casing.
Figure 2:
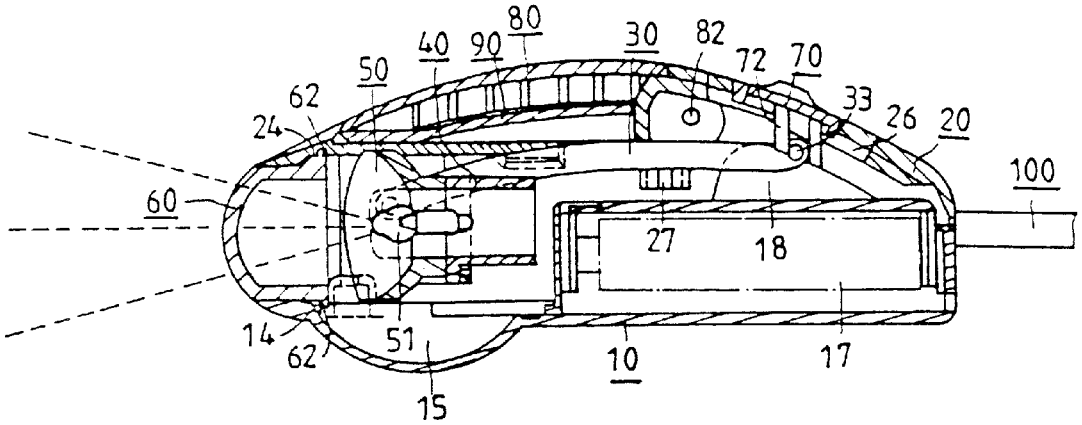
FIG. 2 is a sectional assembly view of a reading lamp of a preferred embodiment while a cover is closed.

Referring to FIGS. 1, 1A and 2, a reading lamp comprises a base seat 10, a hollow casing 20 disposed on the base seat 10, a link device 30 disposed between the base seat 10 and the hollow casing 20, a lamp 50 disposed between the base seat 10 and the hollow casing 20, a button 70 disposed on the hollow casing 20, a transparent plate 90 disposed in the hollow casing 20, and a cover 80 disposed on the hollow casing 20 covering the transparent plate 90.

The base seat 10 has a positioning block 14 disposed in a front portion of the base seat 10, two hollow posts 11 disposed in a front portion of the base seat 10, two grooved plates 16 disposed in a front portion of the base seat 10, two clip grooves 13 formed in a front portion of the base seat 10, a front interior 15, a cell chamber 17 disposed in the base seat 10, an elongated recess 12 formed on a rear portion of the base seat 10, and two rectangular recesses 19 formed on the rear portion of the base seat 10. A triangular block 18 is disposed on the cell chamber 17.

The hollow casing 20 has two pivot seats 252, a through hole 25, two lateral recesses 251, an oblong recess 26, three cage holes 261 formed on the oblong recess 26, a recess seat 27 disposed in the hollow casing 20, a conductive plate 271 disposed on the recess seat 27, a positioning portion 24 formed on a front bottom of the hollow casing 20, two hollow pillars 21 disposed on the front bottom of the hollow casing 20, two clip notches 23 formed on a front bottom of the hollow casing 20, a clip plate 22 disposed on a rear portion of the hollow casing 20, and a rectangular groove 28 formed on the clip plate 22.

The lamp 50 has a bulb 51. A lamp holder 40 has two positioning posts 401 and two columns 41. A link device 30 has two parallel rods 32, two arms 31, each arm 31 having an aperture 311, and a plurality of ribs 33 disposed between the rods 32. The positioning posts 401 are inserted in the apertures 311. The grooved plates 16 receive the columns 41. The lamp 50 couples with the lamp holder 40. Two cylindrical retainers 101 are disposed between the rectangular recesses 19 and the rectangular groove 28. A rope 100 has two ends inserted in the cylindrical retainers 101.

A transparent lamp housing 60 has two positioning protrusions 62 and two clip blocks 61. The transparent lamp housing 60 is disposed between the positioning portion 24 of the hollow casing 20 and the front portion of the base seat 10. The clip blocks 61 engage with the clip grooves 13.

The transparent plate 90 has two lugs 91 inserted in the lateral recesses 251.

The cover 80 has a mirror 83 disposed on a bottom of the cover 80 and two hollow lobes 81 disposed on two rear laterals of the cover 80. Two pivot fasteners 82 pass through the hollow lobes 81 and are inserted in the pivot seats 252. The button 70 has a snap fastener 72 and two clip fasteners 71 inserted in the cage holes 261. The snap fastener 72 is inserted in a spacing defined by the parallel rods 32. The triangular block 18 is inserted in the spacing defined by the parallel rods 32.

Referring to FIG. 2 again, the button 70 is pressed forward. The bulb 51 illuminates forward.

Figure 3:
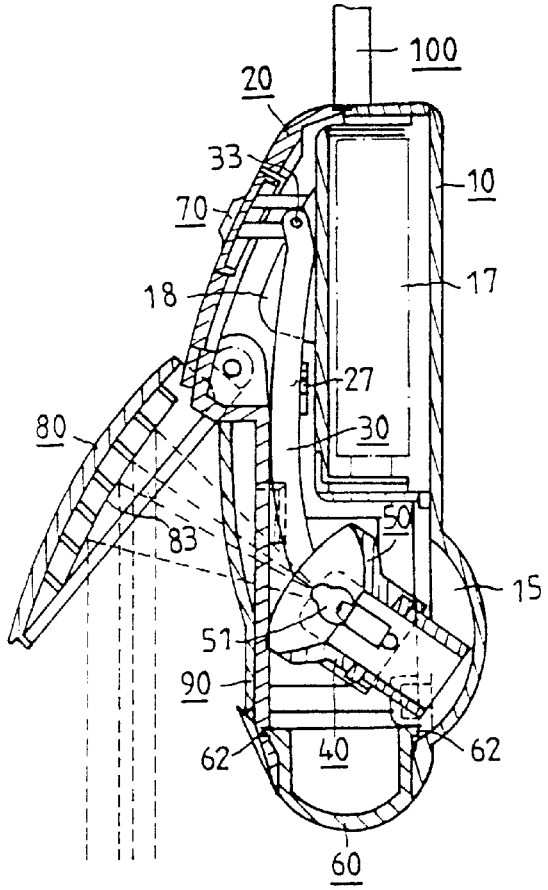
FIG. 3 is a sectional assembly view of a reading lamp of a preferred embodiment while a cover is opened.

Referring to FIG. 3, the button 70 is pressed rearward. The link device 30 will move rearward also. Then the lamp holder 40 and the lamp 50 will move upward. When the use opens the cover 80, the mirror 83 will reflect a light from the bulb 51 to a book (as shown in FIG. 6).

Figure 6:
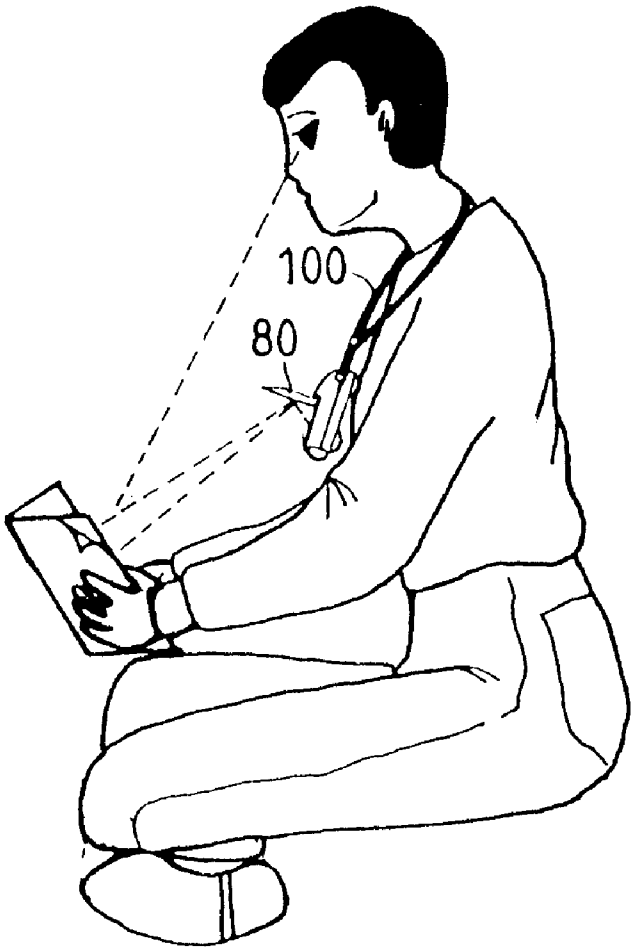
FIG. 6 is a schematic view illustrating an application of a reading lamp of a preferred embodiment in accordance with the present invention.
Figure 4:
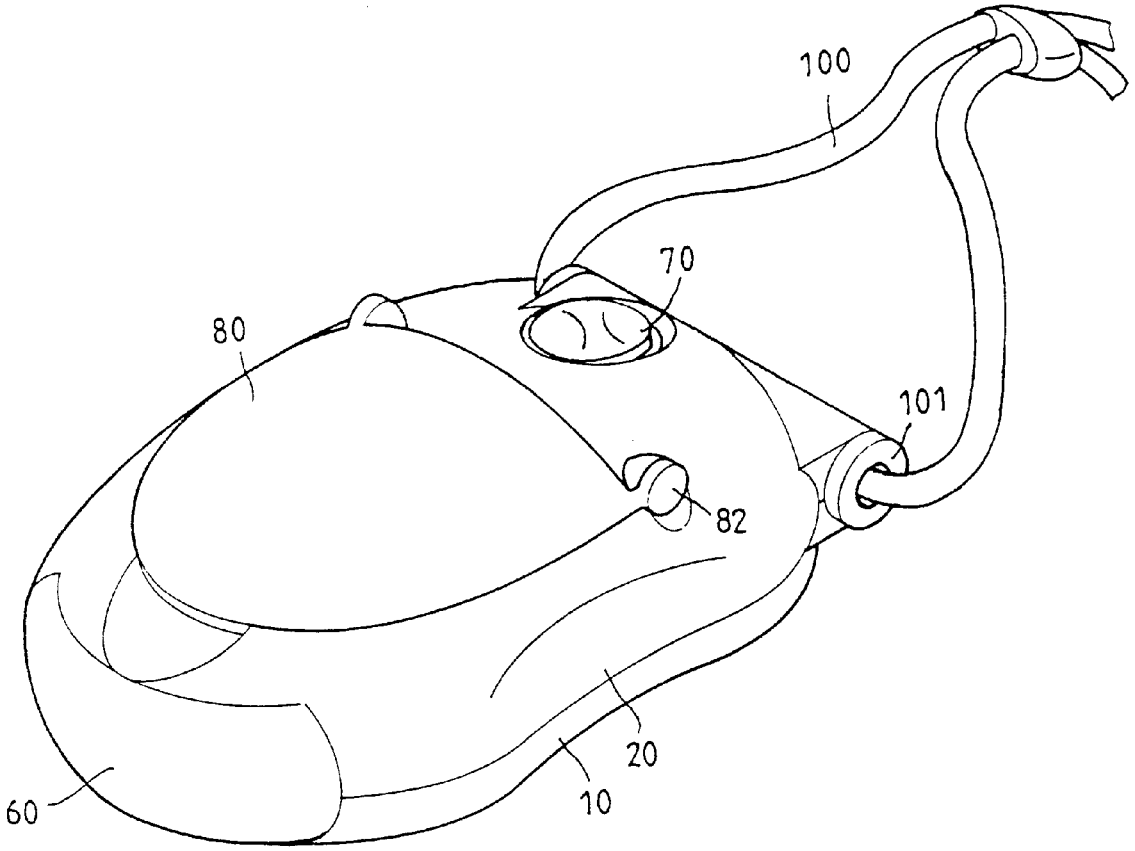
FIG. 4 is a perspective view of FIG. 2.
Figure 5:
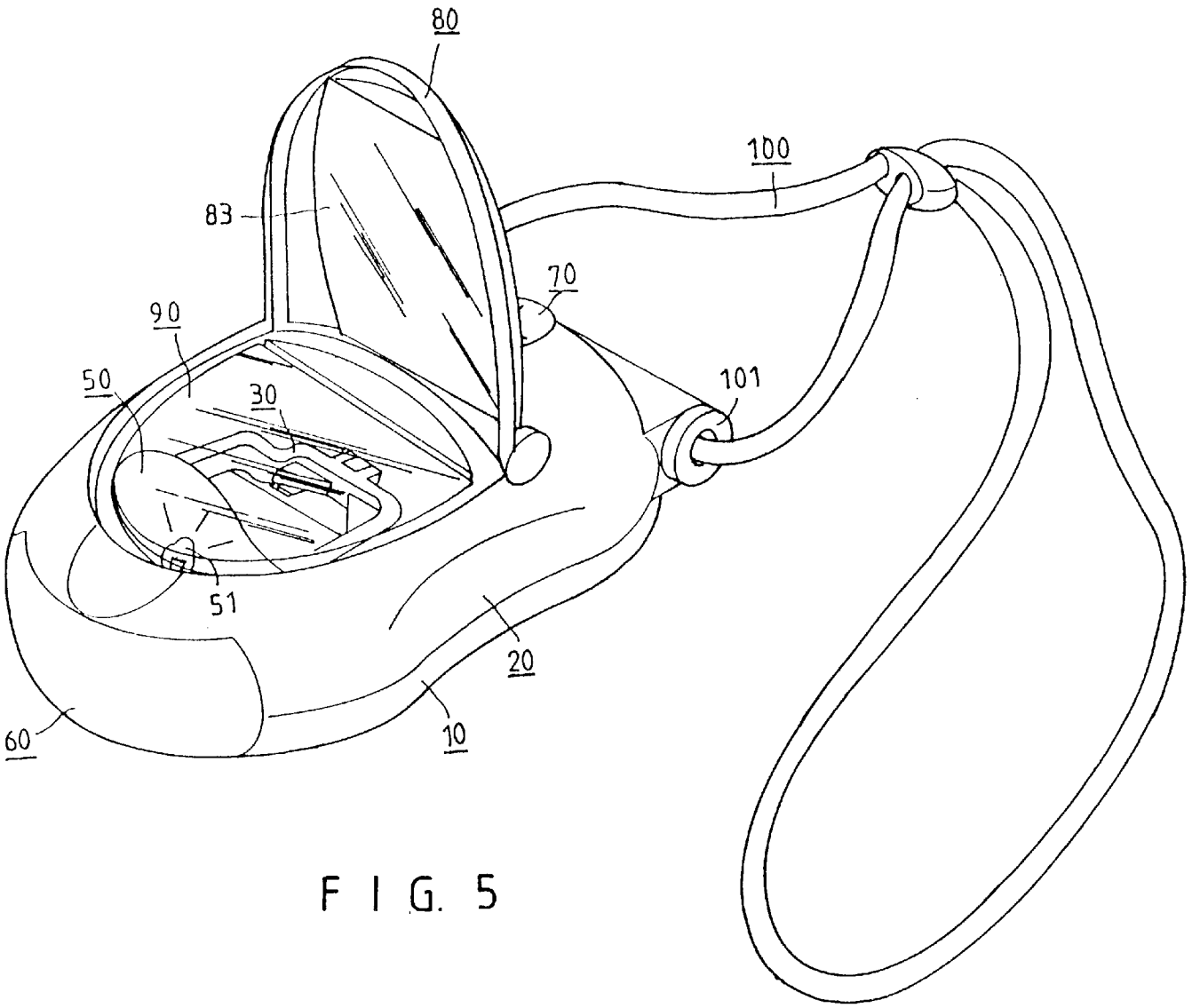
FIG. 5 is a perspective view of FIG. 3.

Referring to FIGS. 4 to 6, the rope 100 is positioned by the cylindrical retainers 101. The user can hang the reading lamp on the neck while reading the book. Thus the user can read the book outdoors at night.

The present invention is not limited to the above embodiment but various modification thereof may be made. Furthermore, various changes in form and detail may be made without departing from the scope of the present invention.

I claim:

1. A reading lamp comprises:

a base seat, a hollow casing disposed on the base seat, a link device disposed between the base seat and the hollow casing, a lamp disposed between the base seat and the hollow casing, a button disposed on the hollow casing, a transparent plate disposed in the hollow casing, a cover disposed on the hollow casing covering the transparent plate, the base seat having a positioning block disposed in a front portion of the base seat, two hollow posts disposed in a front portion of the base seat, two grooved plates disposed in a front portion of the base seat, two clip grooves formed in a front portion of the base seat, a front interior, a cell chamber disposed in the base seat, an elongated recess formed on a rear portion of the base seat, and two rectangular recesses formed on the rear portion of the base seat, a triangular block disposed on the cell chamber, the hollow casing having two pivot seats, a through hole, two lateral recesses, an oblong recess, three cage holes formed on the oblong recess, a recess seat disposed in the hollow casing, a conductive plate disposed on the recess seat, a positioning portion formed on a front bottom of the hollow casing, two hollow pillars disposed on the front bottom of the hollow casing, two clip notches formed on a front bottom of the hollow casing, a clip plate disposed on a rear portion of the hollow casing, and a rectangular groove formed on the clip plate, the lamp having a bulb, a lamp holder having two positioning posts and two columns, a link device having two parallel rods, two arms, each said arm having an aperture and a plurality of ribs disposed between the rods, the positioning posts inserted in the apertures, the grooved plates receiving the columns, the lamp coupling with the lamp holder, a transparent lamp housing having two positioning protrusions and two clip blocks, the transparent lamp housing disposed between the positioning portion of the hollow casing and the front portion of the base seat, the clip blocks engaging with the clip grooves, the transparent plate having two lugs inserted in the lateral recesses, the cover having a mirror disposed on a bottom of the cover and two hollow lobes disposed on two rear laterals of the cover, two pivot fasteners passing through the hollow lobes and being inserted in the pivot seats, the button having a snap fastener and two clip fasteners inserted in the cage holes, the triangular block inserted in a spacing defined by the parallel rods, and the snap fastener inserted in the spacing defined by the parallel rods.

2. A reading lamp as claimed in claim 1, wherein two cylindrical retainers are disposed between the rectangular recesses and the rectangular groove.

3. A reading lamp as claimed in claim 2, wherein a rope has two ends inserted in the cylindrical retainers.

* * * * *